United States Patent [19]

Craven et al.

[11] 4,144,967

[45] Mar. 20, 1979

[54] SHAVING KIT

[76] Inventors: Lawrence C. Craven, 32401 San Bren, Fraser, Mich. 48026; Frank Sherosky, 29101 Hayes, N-26, Warren, Mich. 48093

[21] Appl. No.: 871,775

[22] Filed: Jan. 24, 1978

[51] Int. Cl.[2] ..... B65D 69/00

[52] U.S. Cl. ..... 206/229; 132/80 R; 206/361; 206/477; 206/581

[58] Field of Search ..... 15/172, 176; 132/80 R, 132/81; 206/15.2, 38, 45.14, 45.34, 229, 361, 477, 581, 811, 823; 220/DIG. 6; 401/118, 123–125, 129

[56] References Cited

U.S. PATENT DOCUMENTS

| | | | |
|---|---|---|---|
| 1,188,443 | 6/1916 | Gutman | 206/229 X |
| 1,298,633 | 4/1919 | Alland | 132/80 R |
| 1,932,603 | 10/1933 | Richardson | 132/80 R |
| 2,630,912 | 3/1953 | Warner et al. | 206/15.2 |
| 2,958,329 | 11/1960 | Almgren | 132/80 R |
| 3,842,850 | 10/1974 | Sanders | 401/129 X |

FOREIGN PATENT DOCUMENTS

| | | | |
|---|---|---|---|
| 47648 | 6/1909 | Switzerland | 401/18 |

*Primary Examiner*—Steven E. Lipman
*Attorney, Agent, or Firm*—Charles W. Chandler

[57] ABSTRACT

A compact, portable shaving kit comprising a shaving brush, a container for shaving soap, a container top having an annular member supporting the shaving brush in an upright position, and a cap for enclosing the brush.

1 Claim, 4 Drawing Figures

SHAVING KIT

BACKGROUND OF THE INVENTION

This invention is related to portable shaving kits, and more particularly, to a compact kit which encloses a quantity of shaving soap and a brush for creating a lather from the soap.

Many men continue to use a brush and a safety razor for shaving. The brush, after being used, is usually disposed in an upright position to dry. When the user travels, he places the brush in a loose position in a shaving bag. Because the soap is often in a container too large to conveniently fit in the bag, the user employs conventional hand soap for creating a lather. The better shaving soaps provide a lather which softens and prepares the user's whiskers for shaving. Conventional hand soap does not do as good a job.

SUMMARY OF THE INVENTION

The broad purpose of the present invention is to provide a compact shaving kit for housing both shaving soap and a brush in a water-tight container which is also suited for supporting the brush in an upright position after use. In the preferred embodiment of the invention, the brush is housed in a cap that is mounted on a cover for the soap container. An annular member, mounted on the container cover, has a rim for receiving the base of the brush handle. The rim has an opening which allows the brush to drain when supported in an upright position. When the user has to travel overnight, he can house both the brush, as well as the soap, in a compact water-tight dispenser which not only protects the soap, but also protects the brush bristles.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
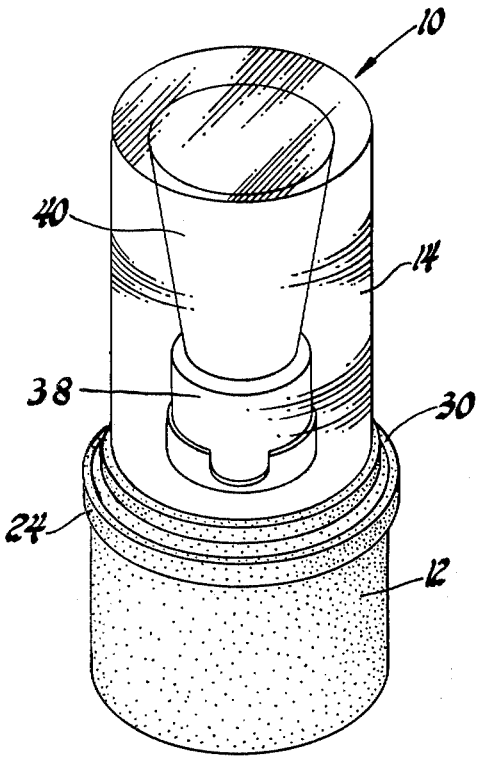
FIG. 1 is a perspective view of a shaving kit illustrating the preferred embodiment of the invention.

Referring to the drawing, FIG. 1 illustrates a shaving kit 10 which includes a base 12 and a cap 14. Base 12 is preferably formed of a plastic material and has a cylindrical sidewall 16 and a bottom 18 forming a hollow chamber.

A quantity of shaving soap 20 is disposed in base 12. The soap is adapted to form a lather when moistened and whipped by a brush. Base 12 has an annular shoulder 22, and a collar 24 defining a top opening for removal of the soap.

A cover 26 is adapted to seat on shoulder 22 to form a slidable, water-tight fit for the top of base 12.

A cap holder 28, having an annular wall 30, is mounted on cover 26.

Figure 2:
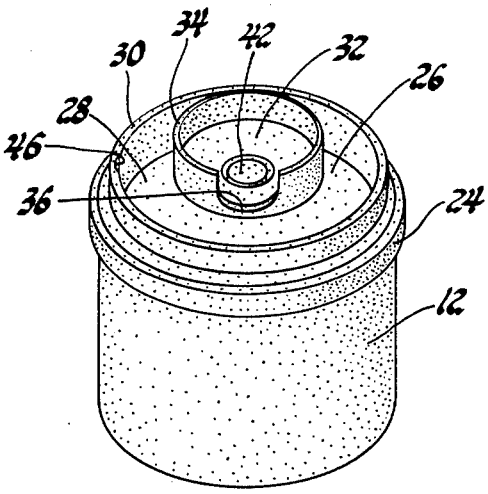
FIG. 2 is a view of the soap container and the container cover.
Figure 3:
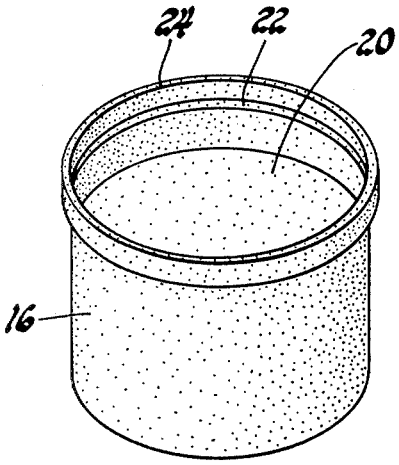
FIG. 3 is a view illustrating the soap container with the cover removed.
Figure 4:
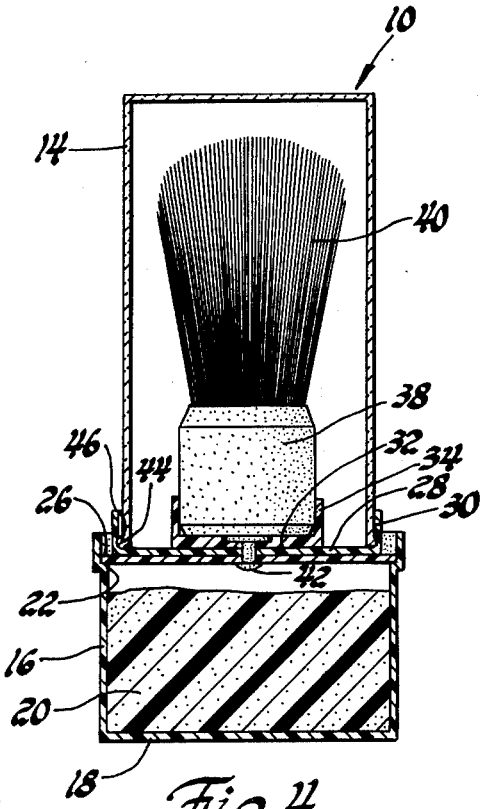
FIG. 4 is an elevational sectional view of the preferred shaving kit.

A brush holder 32, having an annular wall 34, is mounted within holder 28. Wall 34 has a semi-circular opening 36 as best illustrated in FIG. 2.

A conventional shaving brush 38, having bristles 40, is seated with annular wall 34. The handle of brush 38 preferably has a circular cross-section that fits snugly within annular wall 34 in such a manner that the brush can be supported in an upright position when cover 26 is disposed in a horizontal position. Annular wall 34 supports the brush in a fixed position on cover 26 even though the kit is disposed in either a sideways or an upright position. Thus the distance between brush holder 32 and the top of kit 10 is just slightly greater than the full height of brush 38. It is to be noted that semi-circular opening 36 permits any liquid draining from the brush to drain from holder 32.

A rivet 42 connects holder 28, holder 32, and cover 26 together to form a unitary structure. Alternatively, holder 28, holder 32, and cover 26 could be formed of a plastic one-piece construction.

Cap 14 is preferably formed of a transparent plastic material. The bottom of the cap has an annular bead 44 adjusted to snap into an annular opening 46 adjacent the bottom of wall 30. The fit is such that the shaving kit can be tossed around in the shaving bag without separation of the various components. Cap 14 cannot be separated from the container cover unless the user deliberately pulls the two components apart. When the shaving kit is not being used to house the brush, the user can dispose base 12 and cover 26 in his bathroom as a means for supporting the brush in an upright position. Thus cover 26 provides a dual function, it seals off the soap when it is not being used so that it will not dry, and secondly, it provides means for supporting the brush in an upright position so that it will dry.

Having described our invention, we claim:

1. A shaving kit comprising:

a shaving brush having a generally cylindrical handle with a plurality of bristles, said handle having a flat base adapted to support the bristles in an upright position at such times as the handle is mounted on a planar horizontal surface;

a base member having a chamber for containing a quantity of shaving soap, and a top opening for providing access to the soap by said brush bristles;

a cover having a planar, nonperforated body, said body having a diameter accommodating the top opening of the base member and being disposed therein to form a slidable, water tight engagement therewith;

an annular wall carried on said cover, said wall having a diameter larger than the diameter of the brush handle so as to cooperate with the cover to form a liquid reservoir;

annular means attached to the cover and having a diameter accommodating the diameter of the brush handle and receiving same in an upright position in which the annular means prevents motion of the handle in directions parallel to the plane of the cover;

a cap having a cylindrical sidewall with a diameter larger than that of the brush and defining an opening receiving the brush at the extreme edge of said sidewall, said extreme edge being slidably received in the annular wall on the cover; and whereby said cover cooperates with the cap to form a water-tight housing for the brush, and cooperates with the base member to form a water-tight chamber for the shaving soap.

* * * * *